US010697740B2

(12) United States Patent
Ohayon

(10) Patent No.: US 10,697,740 B2
(45) Date of Patent: Jun. 30, 2020

(54) METHOD AND LABEL FOR RECOGNIZING FIGURE BY INFRARED VISION IN ANY ENVIRONMENT

(71) Applicant: RESHET GRAF LTD, Nahariya (IL)

(72) Inventor: Oron Ohayon, Nahariya (IL)

(73) Assignee: RESHET GRAF LTD., Nahariya (IL)

( * ) Notice: Subject to any disclaimer, the term of this patent is extended or adjusted under 35 U.S.C. 154(b) by 0 days.

(21) Appl. No.: 16/098,225

(22) PCT Filed: May 25, 2017

(86) PCT No.: PCT/IL2017/050585
§ 371 (c)(1),
(2) Date: Nov. 1, 2018

(87) PCT Pub. No.: WO2017/212471
PCT Pub. Date: Dec. 14, 2017

(65) Prior Publication Data

US 2019/0145744 A1 May 16, 2019

Related U.S. Application Data

(60) Provisional application No. 62/345,890, filed on Jun. 6, 2016.

(51) Int. Cl.

| | |
|---|---|
| ***G06K 19/00*** | (2006.01) |
| ***F41J 2/02*** | (2006.01) |
| ***F41J 2/00*** | (2006.01) |
| ***G09F 3/00*** | (2006.01) |
| ***G09F 3/10*** | (2006.01) |

(52) U.S. Cl.
CPC . *F41J 2/02* (2013.01); *F41J 2/00* (2013.01); *G09F 3/00* (2013.01); *G09F 3/0294* (2013.01); *G09F 3/0297* (2013.01); *G09F 3/10* (2013.01)

(58) Field of Classification Search
USPC ..... 235/375, 435, 439, 454, 462
See application file for complete search history.

(56) References Cited

U.S. PATENT DOCUMENTS

2002/0063223 A1* 5/2002 DeSteese ..... F28F 13/18 250/493.1
2009/0008541 A1* 1/2009 Boyer ..... F41G 1/36 250/252.1

* cited by examiner

*Primary Examiner* — Matthew Mikels
(74) *Attorney, Agent, or Firm* — Law Offices of Steven W. Weinrieb

(57) ABSTRACT

A label comprising some figures that can be recognized by infrared vision devices. The main object is to put a figure surface on or near a reference surface and cooling one of these surfaces, in order to achieve "cool" surface and "warm" surface, enabling infrared vision devices to discriminate between the surfaces. The cooling of the surface is achieved by a "Latent heat" effect due to a evaporation of a liquid absorbed on said surface.

13 Claims, 3 Drawing Sheets

METHOD AND LABEL FOR RECOGNIZING FIGURE BY INFRARED VISION IN ANY ENVIRONMENT

FIELD OF THE INVENTION

The present invention relates to the field of thermal imaging or infrared vision. More specifically, the present invention relates to signage visible while using infrared imaging techniques, creating targets for calibrating and shooting for infrared weapons sights, creating Identification products for thermal devices, e.g. a patch that will be readable by thermal devices on a firefighter suit or helmet.

BACKGROUND

Infrared vision devices have the ability to view heat sources, such as people, in complete darkness. However, these devices are unable to differentiate words, symbols and other "regular" signs. In order to convey such information, it should be a temperature difference between objects in order to achieve sufficient discrimination.

There is a common method to create images for thermal devices by using different emissivity materials, such as used in passive thermal targets, when a low emissivity base material (usually lower than 0.4 emissivity) is used and a high emissivity material (higher than 0.7 emissivity) is printed or attached to it. The low emissivity material is intended to reflect sky energy, which its temperature on a clear day can drop to 30 Celsius degrees below zero, towards the vision device and appears "cold", while the high emissivity material has the surrounding temperature and appears warmer. This method is limited to outdoor use and sky conditions, moreover the positioning angle is very critical in order to reflect correctly.

In other methods a heated targets is used that requires power source or using a chemical reaction for this purpose.

There are other known methods that are disclosed in some publications;

U.S. Pat. No. 3,986,384 to Giorgi—"Variable Contrast Passive Infrared Target"

U.S. Pat. No. 4,058,734 to Vroombout—"Passive Infrared Resolution Target"

U.S. Pat. No. 4,549,814 to Creel et al.—"Test Plate Having A Thermal Test Pattern"

U.S. Pat. No. 6,806,480 to Reshef—"Multi-Spectral Products", also published by the WIPO under WO 02/03006.

These methods have advantages, drawbacks and limitations. Therefore, the present invention provides a new method that overcame the disadvantages of the mentioned methods and provides a method and a label for recognizing figure or figures by infrared vision devices in any environment.

SUMMARY OF THE INVENTION

The main object of the present invention is to put a figure surface on or near a reference surface and cooling one of these surfaces, in order to achieve "cool" surface and "warm" surface, enabling infrared vision devices to discriminate between the surfaces.

The present invention uses "Latent heat" effect to cool down one of the surfaces. One of the surfaces is made of liquid absorbing material, this surface is wetted by a liquid and while the liquid is evaporated it consumes energy that is coming from the wetted surface, which accordingly cooled down. At the same time, the other surface remains in the surrounding temperature.

The present invention in general comprises a figure that is a physical object that can be used as a sign for, among other things, calibrating an infrared targeting scope. The present invention also provides a method of making such an object that can be used for calibrating an infrared imaging device, such as a thermal camera.

According to a preferred embodiment of the present invention, it provides a method for recognizing a figure or figures, by infrared vision devices, using a related combination of a first and a second surface—a reference surface and a figure surface or vice versa—wherein,

- the first surface, either the reference or the figure, is made of material with a capability to absorb evaporated liquid, wherein the evaporation of the liquid—when exists—cools down the surface;
- the second surface, either the reference or the figure, is made of a low emissivity material. Optionally, this material can be further a hydrophobic material, e.g., Super-hydrophobic coating or nano coating; and
- using the emissivity difference, between two surfaces, to recognize the figure.

According to another preferred embodiment the method can be used by attaching the figure surface on the reference surface.

According to another preferred embodiment the method can be used by printing the figure surface on the reference surface, using a dedicated ink.

According to another preferred embodiment the method can be used by laying both surfaces on mutual base, nearby.

According to another preferred embodiment the method includes a step of wetting the surface that made of material with a capability to absorb liquid.

According to yet another preferred embodiment the method further uses a material that changes its color while wetted for the surface with a capability to absorb liquid.

According to another aspect of the present invention, it provides a label with at least one figure, this figure can be recognized by infrared vision devices, wherein the label made of a related combination of first and second surfaces—a reference surface and a figure surface or vice versa—wherein,

- the first surface, either the reference or the figure, is made of material with a capability to absorb evaporated liquid, wherein the evaporation of the liquid—when exists—cools down the surface; and
- the second surface, either the reference or the figure, is made of a low emissivity material. Optionally, this material can be further a hydrophobic material, e.g., Super-hydrophobic coating or nano coating.

According to another preferred embodiment the label is provided wherein the figure surface is attached on the reference surface.

According to another preferred embodiment the label is provided wherein the figure surface is printed on the reference surface.

According to another preferred embodiment the label is provided wherein the low emissivity material is made of a non-absorbing.

According to yet another preferred embodiment the label is provided wherein the material with a capability to absorb evaporate liquid, has the capability to change its color while it is wet.

According to another preferred embodiment the label is provided, wherein the figure is made of a number of elements or zones surfaces, wherein said elements or zones having a gradient emissivity that enables to discriminate between elements or zones.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE ILLUSTRATED EMBODIMENTS

Figure 1A:
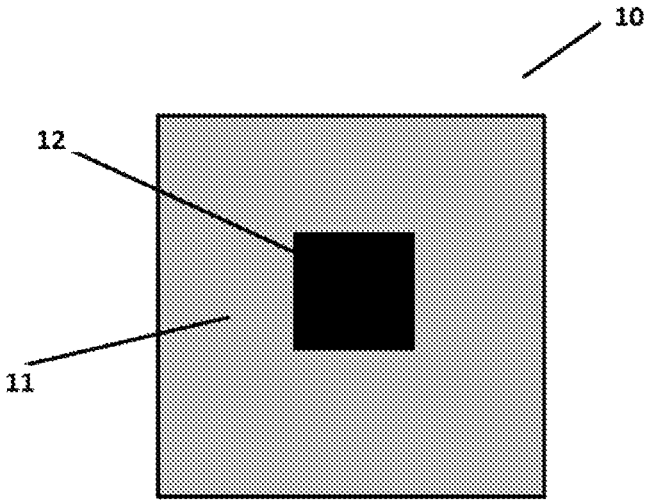
FIG. 1 illustrates a label according to the present invention.

The principles and operation of the method and the label, according to the present invention, may be better understood with reference to the drawing and the accompanying description.

Figure 1B:
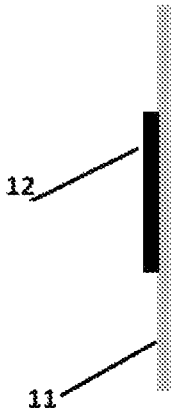

FIG. 1 illustrates a label according to the present invention. The label 10 is made of a reference surface 11 and a figure surface 12. FIG. 1A illustrates the label from the front view and FIG. 1B illustrates the label from the side view. The reference surface 11 can be made of material with a capability to absorb evaporate liquid, while the figure surface 12 is made of a low emissivity material preferably non-absorbing material—or vice versa—the reference surface 11 can be made of a low emissivity material preferably non-absorbing material, while the figure surface 12 is made of material with a capability to absorb evaporate liquid.

Liquid absorbing material, can be any material that can get wet and doesn't repels liquid, not limited to fabrics and paper. It needs to have a higher emissivity than 0.7 in order to get cooler from the evaporation effect.

Figure 2A:
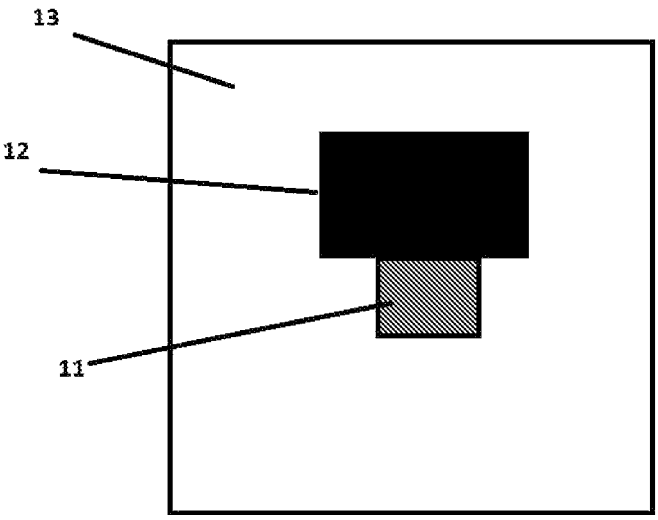
FIG. 2 illustrates side by side surfaces method.
Figure 2B:
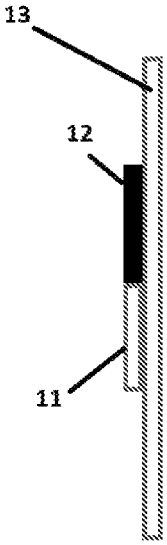

FIG. 2 illustrates side by side surfaces method. FIG. 2A illustrates a front view and FIG. 2B illustrates side view. In this figure the reference surface 11 and the figure surface 12 are laid side by side of on a mutual base 13. As described in FIG. 1, one of the surfaces can be made of material with a capability to absorb evaporate liquid, while the other is made of a low emissivity material preferably non-absorbing material.

Figure 3:
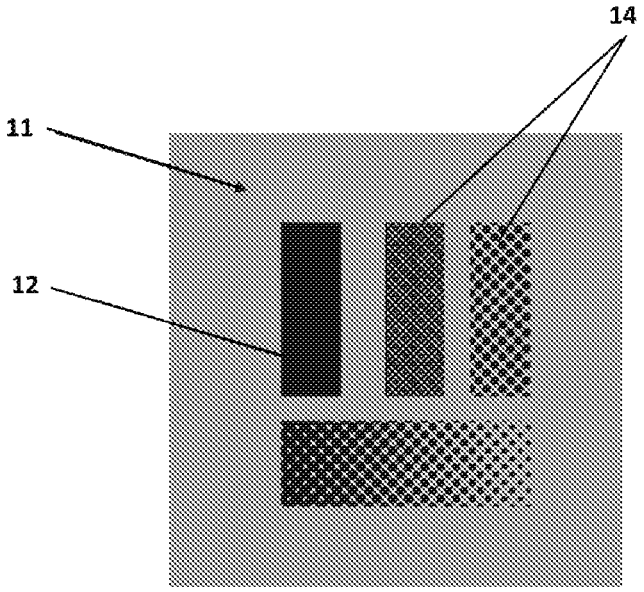
FIG. 3 illustrates label with gradient image.

FIG. 3 illustrates label with gradient image. In another configuration, the figure surface 12 can be made to create gradient image 14 in the thermal device by using a gradient emissivity surface that have different emissivity zones or graphics that will be differently affected by the absorbing layer or alternatively, a gradient can be created with the absorbing layer by using different density or different absorbing capability.

The invention claimed is:

1. A method for recognizing a figure by an infrared vision device using a related combination of a first surface and a second surface, comprising the steps of:

forming said first surface from a material which is capable of absorbing an evaporative liquid; and forming said second surface from a material which is a non-absorbing, low-emissivity material, whereby when said evaporative liquid evaporates from said first surface, said first surface will be cooled to a predetermined degree such that the difference in temperature between said first surface and said second surface will enable said figure to be detected by infrared vision devices.

2. The method of claim 1, further comprising the step of:

using a material that is also a hydrophobic material for said second surface.

3. The method of claim 1, further comprising the step of:

attaching said first surface onto said second reference surface.

4. The method of claim 1, further comprising the step of:

printing said first surface onto said second surface using a dedicated ink.

5. The method of claim 1, further comprising the step of:

laying both surfaces upon a common base member.

6. The method of claim 1, further includes a step of wetting the surface that made of material with a capability to absorb liquid.

7. The method of claim 6, further using a material that changes its color while wetted for said surface with a capability to absorb liquid.

8. A label with a figure which can be recognized by an infrared vision device, wherein said label comprises a combination of first and second surfaces and wherein:

said first surface is fabricated from a material which is capable of absorbing an evaporative liquid; and said second surface is fabricated from a material which is a non-absorbing, low-emissivity material, whereby when said evaporative liquid evaporates from said first surface, said first surface will be cooled to a predetermined degree such that the difference in temperature between said first surface and said second surface will enable said figure to be detected by infrared vision devices.

9. The label of claim 8, wherein:

said first surface is attached to said second surface.

10. The label of claim 8, wherein:

said first surface is printed on said second surface.

11. The label of claim 8, wherein:

said first material which is capable of absorbing an evaporative liquid has the capability to change its color when it is rendered wet as a result of absorbing the evaporative liquid.

12. The label of claim 8, wherein:

said figure comprises a plurality of zones wherein said plurality of zones exhibit different gradient degrees of emissivity, depending upon different liquid absorption capabilities of said different zones of said figure, such that an infrared detection device is enabled to discriminate between said different zones of said figure.

13. The label of claim 8, wherein:

said second surface is made a material that is also a hydrophobic material.

* * * * *